United States Patent [19]

Choushi et al.

[11] Patent Number: 4,516,546

[45] Date of Patent: May 14, 1985

[54] V-TYPE OVERHEAD-CAMSHAFT ENGINE

[75] Inventors: Masahiro Choushi, Hiroshima; Tetsuji Yahiro, Higashihiroshima, both of Japan

[73] Assignee: Mazda Motor Corporation, Japan

[21] Appl. No.: 601,729

[22] Filed: Apr. 18, 1984

[30] Foreign Application Priority Data

Apr. 18, 1983 [JP] Japan ..... 58-68788
Mar. 29, 1984 [JP] Japan ..... 59-61723

[51] Int. Cl.[3] ..... F02B 77/14

[52] U.S. Cl. ..... 123/195 A; 123/195 C; 123/198 E; 123/193 H; 123/DIG. 7

[58] Field of Search ..... 123/195 A, 195 C, 193 H, 123/198 E, 90.27, DIG. 6, DIG. 7

[56] References Cited

U.S. PATENT DOCUMENTS

| | | | |
|---|---|---|---|
| 2,172,100 | 9/1939 | Hoffman et al. | 123/195 A |
| 2,660,987 | 12/1953 | Doughty | 123/195 A |
| 4,007,723 | 2/1977 | Laughton | 123/195 A |
| 4,054,108 | 10/1977 | Gill | 123/195 A |
| 4,129,043 | 12/1978 | Ishikawa | 123/195 A |

FOREIGN PATENT DOCUMENTS 55-114845 4/1980 Japan .

*Primary Examiner*—Ira S. Lazarus

*Attorney, Agent, or Firm*—Murray, Whisenhunt & Ferguson

[57] ABSTRACT

A V-type overhead-camshaft engine comprises first and second banks arranged in V-shape, each bank having a row of a plurality of cylinders extending axially between front and rear ends thereof. The row of the cylinders in the first bank starts from a location spaced apart from the front end of the engine, and terminates at a location near the rear end of the same. The row of the cylinders in the second bank starts from a location near the front end of the engine and terminates at a location spaced apart from the rear end of the same. Each bank is provided with a cylinder head assembly which generally comprises a cylinder head and a head cover, and supports a camshaft. The cylinder head assembly of the first bank is provided with an opening at a location corresponding to the part of the bank between the front end of the engine and the foremost cylinder in the first bank, while the cylinder head assembly of the second bank is provided with an opening at a location corresponding to the part of the second bank between the rear end of the engine and the rearmost cylinder in the second bank. The openings in the cylinder head assemblies of the first and second banks are identical to each other and are located symmetrically with respect to the center of the engine. One of the openings is used as an oil filler section, and the other opening is used as an engine auxiliary mechanism mounting section.

14 Claims, 7 Drawing Figures

V-TYPE OVERHEAD-CAMSHAFT ENGINE

BACKGROUND OF THE INVENTION

1. Field of the Invention

This invention relates to a V-type overhead-camshaft engine.

2. Description of the Prior Art

In Japanese Unexamined Patent Publication No. 55(1980)-114845, there is disclosed an auxiliary mechanism mounting system for a V-type overhead-valve engine in which one of a pair of V-arranged banks is displaced in the axial direction of the crankshaft with respect to the other so as to provide spaces at a location axially ahead of the one bank and at a location axially behind the other bank, and auxiliary mechanisms for the engine to be driven by the crankshaft are disposed in the spaces, thereby reducing the overall size of the engine. However, the auxiliary mechanism mounting system is for a V-type overhead-valve engine and cannot be directly applied to a V-type overhead-camshaft engine in which the auxiliary mechanisms are to be mounted by way of mounting holes.

SUMMARY OF THE INVENTION

Accordingly, the primary object of the present invention is to provide a V-type overhead-camshaft (OHC) engine in which an auxiliary mechanism for the engine such as a distributor, a fuel pump, or an injection pump (in the case of a diesel engine) to be driven by the camshaft can be mounted without increasing the overall size of the engine.

Another object of the present invention is to provide a V-type OHC engine in which the cylinder head assemblies (generally comprising a cylinder head and a cylinder-head cover) for the respective banks can be of identical shape to contribute to reduction of the manufacturing cost.

The V-type OHC engine of the present invention comprises first and second cylinder banks arranged in V-shape, each cylinder bank having a row of a plurality of cylinders extending axially between front and rear ends thereof. The row of the cylinders in the first cylinder bank starts from a location spaced apart from the front end of the engine and terminates at a location near the rear end of the same, while the row of the cylinders in the second cylinder bank starts from a location near the front end of the engine and terminates at a location spaced apart from the rear end of the same so that the row of the cylinders in the first cylinder bank is axially rearwardly displaced from that in the second cylinder bank. Each cylinder bank is provided with a cylinder-head assembly which generally comprises a cylinder head and a cylinder-head cover, and supports a camshaft. The cylinder-head assembly of the first cylinder bank is provided with an opening at a location corresponding to the part of the first cylinder bank between the front end of the engine and the foremost cylinder in the first cylinder bank, i.e., the cylinder nearest to the front end of the engine in the first cylinder bank. Further, the cylinder-head assembly of the second cylinder bank is provided with an opening at a location corresponding to the part of the second cylinder bank between the rear end of the engine and the rearmost cylinder in the second cylinder bank, i.e., the cylinder nearest to the rear end of the engine in the second cylinder bank. The openings in the cylinder-head assemblies of the first and second cylinder banks are identical to each other and are located symmetrically with respect to the center of the engine. One of the openings is used as an oil filler section and is provided with an oil filler cap, while the other opening is used as an auxiliary mechanism mounting section. This arrangement permits the cylinder-head assemblies for the first and second cylinder banks to be of identical shape. The opening of each cylinder head assembly may be formed either in the cylinder head or in the cylinder-head cover.

DESCRIPTION OF THE PREFERRED EMBODIMENT

Figure 1:
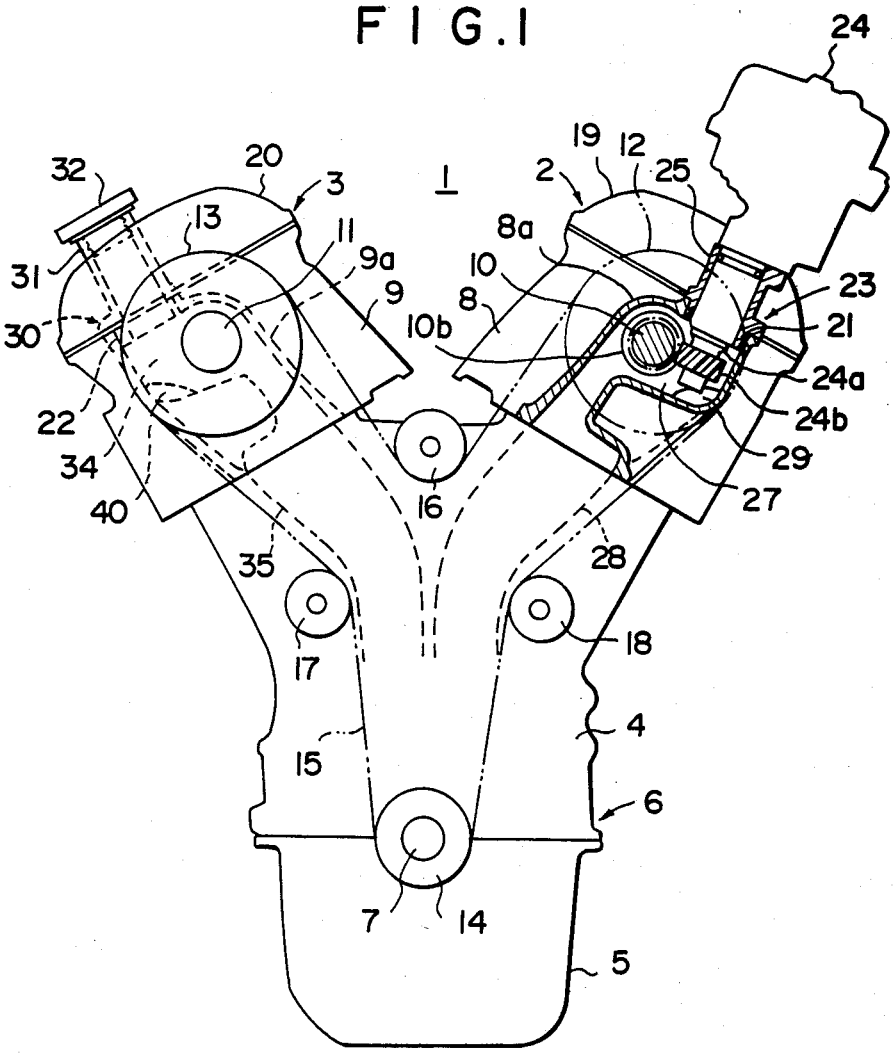
FIG. 1 is a front elevational view partially in cross section of a V-6 OHC engine in accordance with an embodiment of the present invention.

Referring to FIGS. 1 to 4, a V-6 OHC engine 1 in accordance with an embodiment of the present invention comprises a cylinder block 4 having a first cylinder bank 2 and a second cylinder bank 3 arranged in V-shape. Secured to the bottom of the cylinder block 4 is an oil pan 5 which forms, together with the lower part of the cylinder block 4, a crankcase 6 in which is disposed a crankshaft 7.

Mounted on the top surfaces of the first and second banks 2 and 3 of the cylinder block 4 in an air-tight fashion are first and second cylinder heads 8 and 9. First and second camshafts 10 and 11 are respectively supported on the first and second cylinder heads 8 and 9. The camshafts 10 and 11 are operatively connected at their front ends with the crankshaft 7 through a transmission means so that they are driven to rotate in synchronization with the rotation of the crankshaft 7. The transmission means comprises timing pulleys 12 and 13 respectively fixedly mounted on the front ends of the camshafts 10 and 11, a crank pulley 14 fixed on the front end of the crankshaft 7, and a timing belt 15 entrained around the pulleys 12, 13 and 14. Reference numerals 16, 17 and 18 denote idlers for the timing belt 15.

Figure 2:
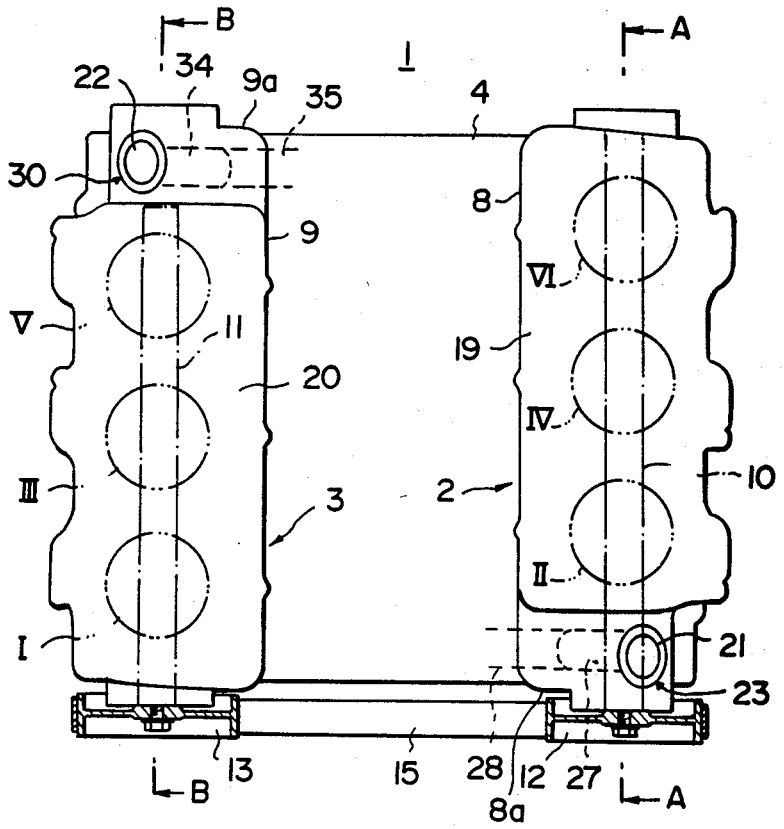
FIG. 2 is a schematic plan view of the engine.

As clearly shown in FIG. 2, in the first cylinder bank 2 of the cylinder block 4, there is formed a row of three cylinders assigned even numbers II, IV and VI, whereas in the second cylinder bank 3, there is formed a row of three cylinders assigned odd numbers I, III and V, the cylinders being numbered from front to rear. The row of the cylinders II, IV and VI in the first cylinder bank 2 starts from a location spaced apart from the front end of the cylinder block 4 and terminates at a location near the rear end of the same, while the row of the cylinders I, III and V in the second cylinder bank 3 starts from a location near the front end of the cylinder block 4 and terminates at a location spaced apart from the rear end of the same by a distance equal to the distance by which the cylinder II (nearest to the front end of the cylinder block 4 in the cylinders of the first bank 2) is spaced apart from the front end of the cylinder block 4. That is, the row of the cylinders of the first cylinder bank 2 is axially rearwardly displaced from that of the second cylinder bank 3.

To the top surfaces of the first and second cylinder heads 8 and 9 are respectively attached first and second cylinder-head covers 19 and 20. As clearly shown in FIG. 2, the first and second cylinder-head covers 19 and 20 are identical to each other and are positioned rotated by 180° with respect to each other. That is, the cylinder-head covers for the first and second cylinder banks 2 and 3 are of identical shape and are interchangeable with each other. The cylinder-head covers 19 and 20 are shorter than the cylinder heads 8 and 9. The first cylinder-head cover 19 is positioned on the first cylinder head 8 so that the part 8*a* of the first cylinder head 8 between the cylinder II (the foremost cylinder) and the front end of the cylinder block 4 is exposed. Similarly, the second cylinder-head cover 20 is positioned on the second cylinder head 9 so that the part 9*a* of the second cylinder head 9 between the cylinder V (the rearmost cylinder in the second cylinder bank 3) and the rear end of the cylinder block 4 is exposed. The first cylinder head 8 is provided with an opening 21 at the part 8*a* and the second cylinder head 9 is provided with an opening 22 at the part 9*a*. The openings 21 and 22 are identical to each other in size and shape, and are positioned symmetrically with respect to the center of the engine. That is, the first and second cylinder heads 8 and 9 are the same member and are positioned rotated by 180° with respect to each other.

Figure 3:
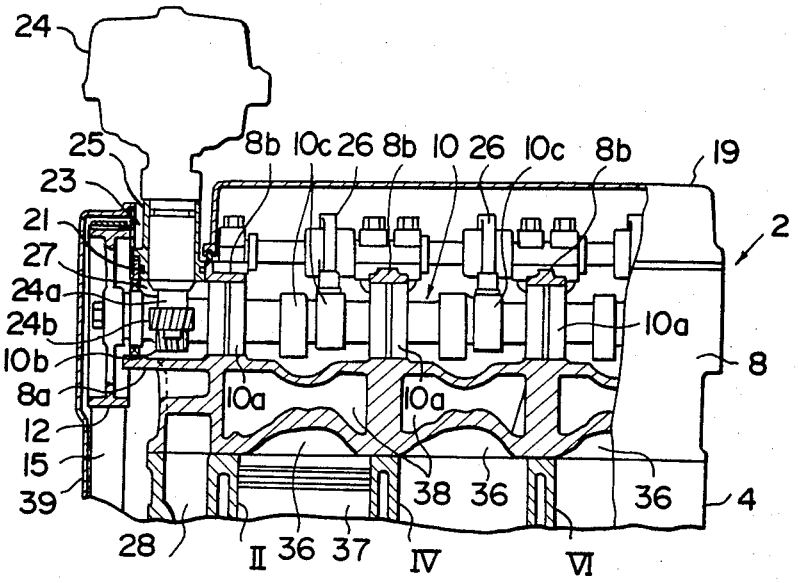
FIG. 3 is a cross-sectional view taken along line A—A in FIG. 2.

The opening 21 in the first cylinder head 8 forms an auxiliary mechanism mounting section 23 for mounting an auxiliary mechanism for the engine 1 which is a distributor 24 in this particular embodiment. As shown in FIG. 3, a tubular member 25 is snugly fitted into the opening 21 and is fixed in the place to project upwardly. The distributor 24 is mounted on the tubular member 25 with its rotary shaft 24*a* being inserted into the tubular member 25 so that the lower end portion of the rotary shaft 24*a* projects into an interior space 27 of the first cylinder head 8. A worm wheel 24*b* is fixedly mounted on the lower end portion of the rotary shaft 24*a* of the distributor 24. The worm wheel 24*b* is in mesh with a worm gear 10*b* fixed to the first camshaft 10 so that the distributor 24 is driven to rotate in synchronization with rotation of the first camshaft 10.

Large diameter portions 10*a* of the first camshaft 10 are received for rotation in bearing portions 8*b* formed in the first cylinder head 8 between the cylinders II and IV and between the cylinders IV and VI. Reference numerals 10*c* denote cam portions on the first camshaft 10. One end of each rocker arm 26 which is operatively connected with intake valve or exhaust valve (not shown) is abutted against the cam portion 10*c* of the first camshaft 10. The front end portion of the first camshaft 10 extends through the interior space 27 formed in the part 8*a* of the first cylinder head 8, and said worm gear 10*b* is provided on the portion of the first camshaft 10 extending through the space 27. The interior space 27 communicates with the opening 21 at its upper portion and with an oil-return passage 28, at its lower portion, which is formed in the cylinder block 4 along the front end face thereof. The oil-return passage 28 is further communicated with an interior space in the remaining part of the first cylinder head 8, by way of a communicating hole 29 (FIG. 1) to return oil from the first cylinder head 8 to the oil pan 5.

Figure 4:
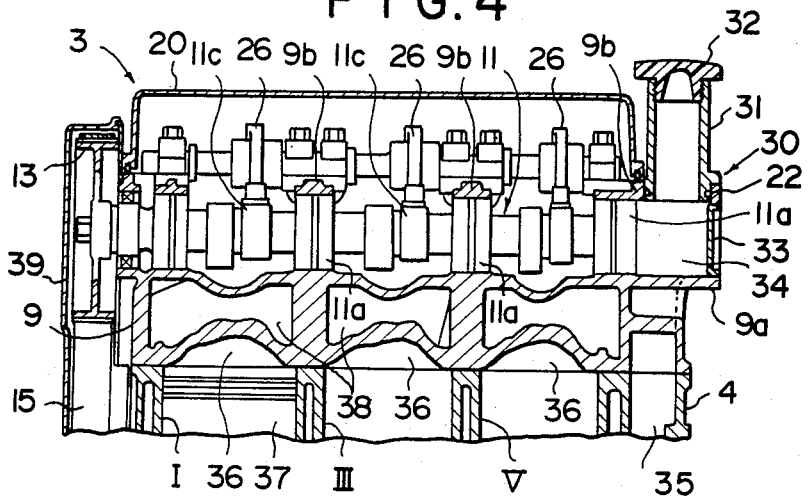
FIG. 4 is a cross sectional view taken along line B—B in FIG. 2.

The opening 22 in the second cylinder head 9 forms an oil-filler section 30. As shown in FIG. 4, a tubular member 31 is snugly fitted into the opening 22 and is fixed in the place to project upwardly. An oil-filler cap 32 is demountably screwed into the projecting end of the tubular member 31. Large diameter portions 11*a* of the second camshaft 11 are received for rotation in bearing portions 9*b* formed in the second cylinder head 9 between the cylinders I and III and between the cylinders III and V. Reference numerals 11*c* denote cam portions on the second camshaft 11.

The tubular member 31 projects into an interior space 34 formed in the part 9*a* of the second cylinder head 9. The interior space 34 communicates with the opening 22 at its upper portion and with an oil-return passage 35, at its lower portion, which is formed in the cylinder block 4 along the rear end face thereof. The oil-return passage 35 is further communicated with an interior space in the remaining part of the second cylinder head 9 by way of a communicating hole 40 to return oil from the second cylinder head 9 to the oil pan 5. As can be seen from FIG. 4, the rear end portion of the second camshaft 11 does not project into the interior surface 34.

In FIGS. 3 and 4, reference numerals 33 and 36 to 39 respectively denote a camshaft rear bearing bore plug, combustion chambers of the cylinders I to VI, pistons, water jacket and a timing-belt case.

With the above arrangement, the engine auxiliary mechanism mounting section 23 and the oil-filler section 30 are disposed in vacant or dead spaces which are formed forwardly of the foremost cylinder II of the first bank 2 and rearwardly of the rearmost cylinder V of the second bank 3 in a V-type OHC engine. Therefore, it is not necessary to extend the overall axial length of the engine for formation of the oil filler section and the engine auxiliary mechanism mounting section. Further, since the spaces are free spaces of the respective cylinder banks 2 and 3, wide oil return passages communicating with the oil pan 5 can be formed in the cylinder block 4 below the auxiliary mechanism mounting section 23 and the oil-filler section 30.

Though in the above embodiment, the oil-filler section 30 is provided in the second cylinder bank 3 and the engine auxiliary mechanism mounting section 23 is provided in the first cylinder block 2, the reverse arrangement may be employed. That is, an engine auxiliary mechanism, e.g., a distributor, may be mounted on the second cylinder head 9 and the oil-filler section 30 may be formed on the first cylinder head 8.

In the embodiment described above in which the openings 21 and 22 for forming the auxiliary mechanism mounting section and the oil filler section are formed in the cylinder heads, the cylinder-head covers 19 and 20 need not be rigid and may be made of plactic, for instance.

A further embodiment of the present invention in which the openings for forming the auxiliary mechanism mounting section and the oil filler section are formed in the cylinder-head covers will now be described referring to FIGS. 5 to 7.

Figure 5:
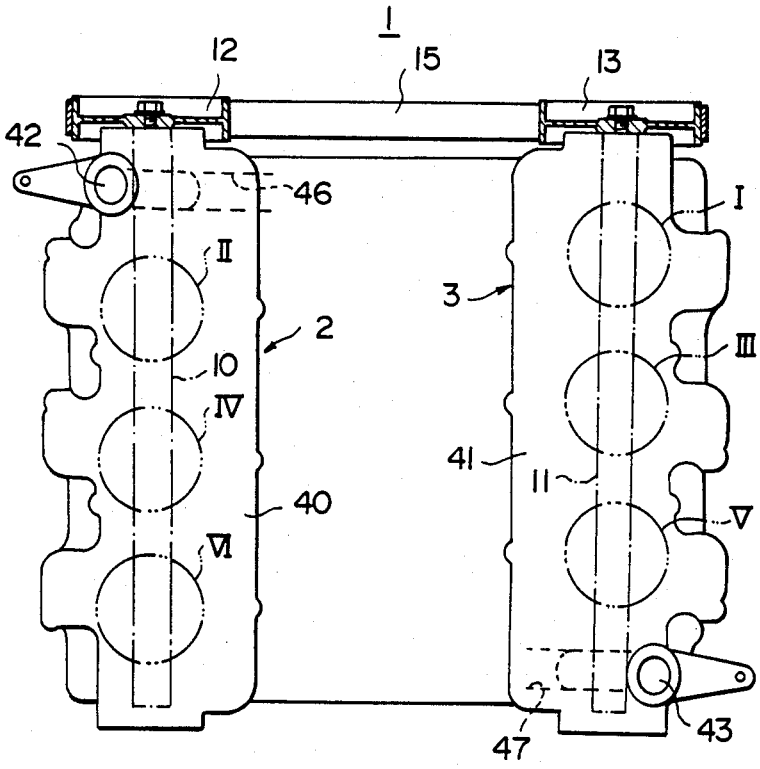
FIG. 5 is a schematic plan view of a V-6 OHC engine in accordance with another embodiment of the present invention.
Figure 6:
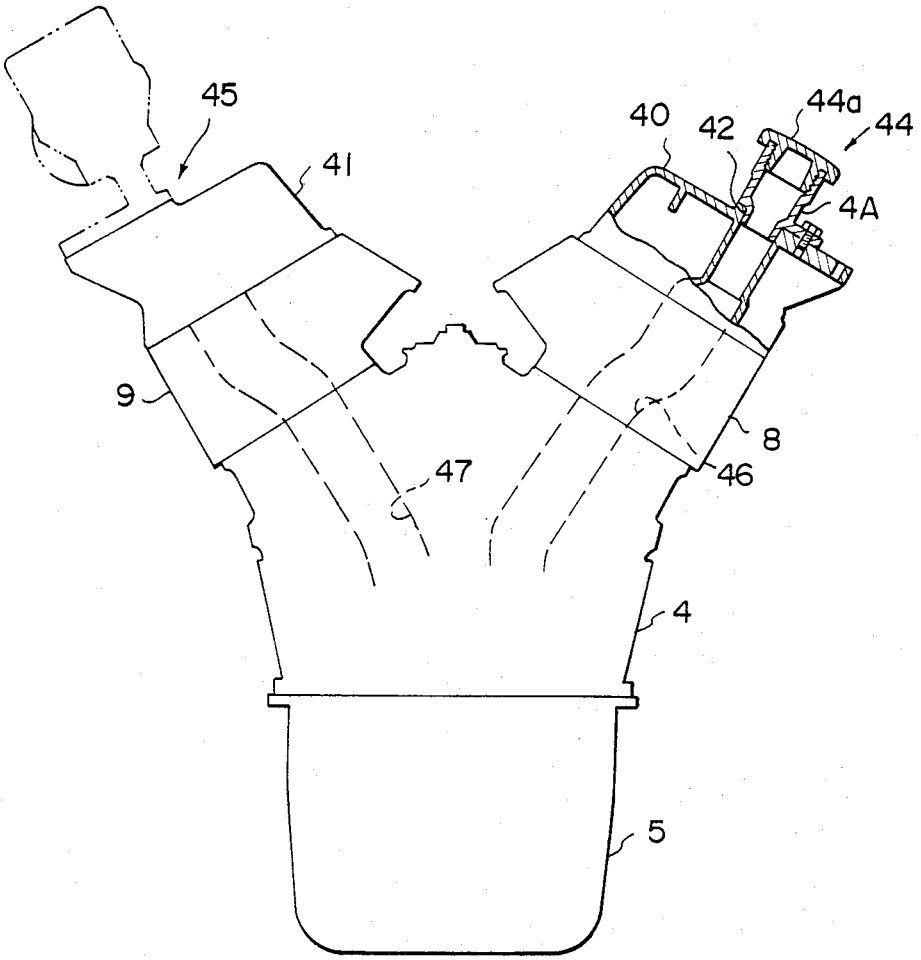
FIGS. 6 and 7 are front elevational views partially in cross section of the engine.
Figure 7:
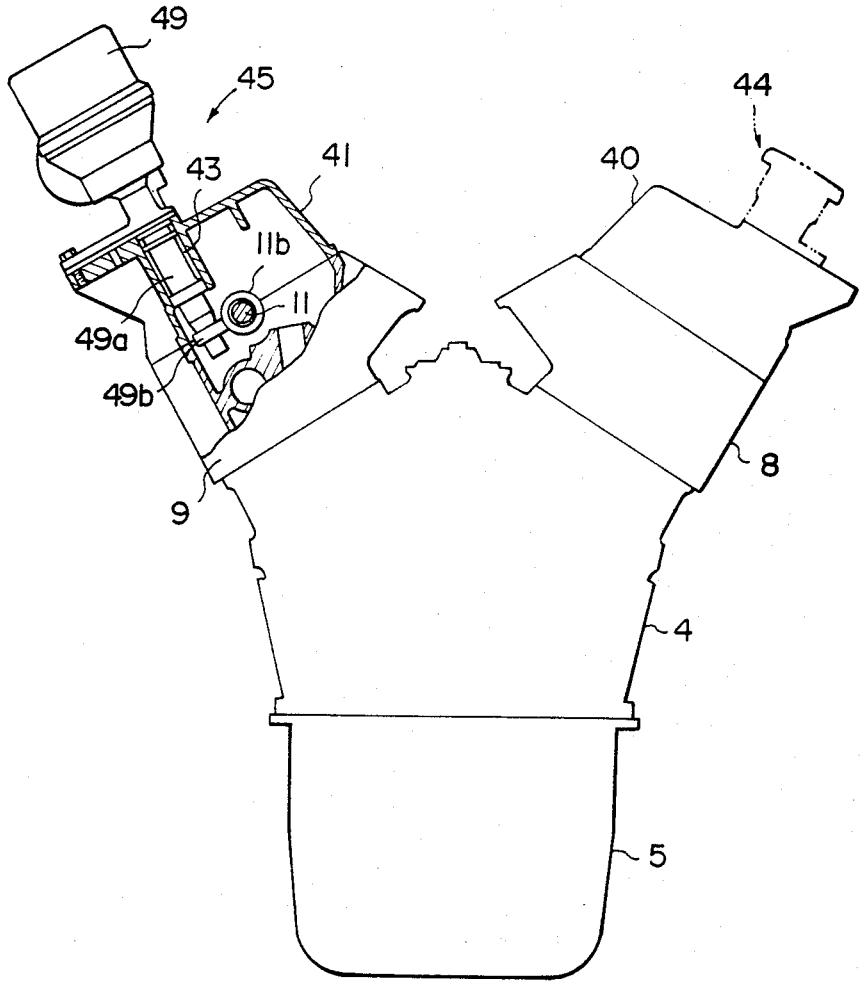

In FIGS. 5 to 7, parts analogous to the parts shown in FIGS. 1 to 4 are given the same reference numerals as in FIGS. 1 to 4. In FIGS. 5 to 7, first and second cylinder-head covers 40 and 41 are respectively attached to the top surfaces of the first and second cylinder heads 8 and 9. The cylinder-head covers 40 and 41 cover substantially the entire length of the respective cylinder heads 8 and 9 as best shown in FIG. 5. The first cylinder-head cover 40 is provided with an opening 42 at a location corresponding to the part of the first cylinder bank 2 between the front end face of the cylinder block 4 and the foremost cylinder II. The second cylinder-head cover 41 is provided with an opening 43 at a location corresponding to the part of the second cylinder bank 3 between the rear end face of the cylinder block 4 and the rearmost cylinder V. The openings 42 and 43 are identical to each other in shape and size, and are positioned symmetrically with respect to the center of the engine 1. That is, the first and second cylinder-head covers 40 and 41 are identical to each other and are positioned rotated by 180° with respect to each other.

The opening 42 in the first cylinder-head cover 40 communicates with an oil return passage 46 which is similar to the oil return passage 28 in the embodiment shown in FIGS. 1 to 4 and is formed along the front end face of the cylinder block 4 at the first bank 2. The opening 43 in the second cylinder-head cover 41 communicates with an oil-return passage 47 which is similar to the oil return passage 35 in the embodiment shown in FIGS. 1 to 4 and is formed along the rear end face of the cylinder block 4 at the second bank 3.

A tubular member 48 is snugly fitted into the opening 42 of the first cylinder-head cover 40 and is fixed in place to form an oil-filler section 44. An oil-filler cap 44*a* is demountably attached to the top of the tubular member 48. The opening 43 of the second cylinder-head cover 41 forms an auxiliary mechanism mounting section 45 for mounting an auxiliary mechanism for the engine 1 which is a distributor in this embodiment. The distributor 49 is mounted on the second cylinder-head cover 41 with its rotary shaft 49*a* being inserted into the opening 43. A worm wheel 49*b* on the lower end portion of the rotary shaft 49*a* is in mesh with a worm gear 11*b* fixed to the second camshaft 11 so that the distributor 49 is driven to rotate in synchronization with rotation of the second camshaft 11.

Though in the embodiment shown in FIGS. 1 to 4, the camshafts 10 and 11 are supported by bearing portions 8*b* and 9*b* in the form of bores in the cylinder heads 8 and 9, the camshafts 10 and 11 in this embodiment are supported by bearings which are formed by bearing half shells respectively provided in the cylinder head and the cylinder-head cover as can be understood from FIG. 7.

We claim:

1. A V-type overhead-camshaft engine comprising first and second cylinder banks arranged in V-shape and respectively having a first cylinder head assembly and a second cylinder head assembly for supporting first and second camshafts, the first and second camshafts being operatively connected at their one end with one end of a crankshaft for synchronized rotation with the crankshaft, a row of a plurality of cylinders being formed in each cylinder bank to extend in the axial direction of the camshaft between front and rear ends of the engine the row of the cylinders in the first cylinder bank starting from a location spaced apart from the front end of the engine and terminating at a location near the rear end of the same, the row of the cylinders in the second cylinder bank starting from a location near the front end of the engine and terminating at a location spaced apart from the rear end of the same, wherein said first cylinder head assembly is provided with an opening at a location corresponding to the part of the first cylinder bank between the front end of the engine and the foremost cylinder in the first cylinder bank and said second cylinder head assembly is provided with an opening at a location corresponding to the part of the second cylinder bank between the rear end of the engine and the rearmost cylinder in the second cylinder bank, the openings in the cylinder head assemblies being identical to each other and located symmetrically with respect to the center of the engine as viewed from above, one of the openings forming an oil filler section, and the other opening forming an engine auxiliary mechanism mounting section for mounting an engine auxiliary mechanism which is to be driven by the corresponding camshaft.

2. A V-type overhead-camshaft engine as defined in claim 1 in which each of said first and second cylinder head assemblies comprises a cylinder head and a head cover, and said opening in the cylinder head assembly is formed in the head cover.

3. A V-type overhead-camshaft engine as defined in claim 2 in which said head covers of the first and second cylinder head assemblies are of identical shape.

4. A V-type overhead-camshaft engine as defined in claim 3 in which said cylinder heads of the first and second cylinder head assemblies are of identical shape.

5. A V-type overhead-camshaft engine as defined in claim 1 in which each of said first and second cylinder head assemblies comprises a cylinder head and a head cover, and said opening in the cylinder head assembly is formed in the cylinder head.

6. A V-type overhead-camshaft engine as defined in claim 5 in which said cylinder heads of the first and second cylinder head assemblies are of identical shape.

7. A V-type overhead-camshaft engine as defined in claim 6 in which said head covers of the first and second cylinder head assemblies are of identical shape.

8. A V-type overhead-camshaft engine as defined in claim 1 in which said opening forming the oil filler section is provided with a detachable oil filler cap.

9. A V-type overhead-camshaft engine as defined in claim 1 in which said openings in the respective cylinder head assemblies open upwardly.

10. A V-type overhead-camshaft engine as defined in claim 1 in which said engine auxiliary mechanism mounted on the engine auxiliary mechanism mounting section has a driving shaft projecting into said the other opening, the driving shaft being provided with a worm wheel which is in mesh with a worm gear fixed to the corresponding camshaft.

11. A V-type overhead-camshaft engine as defined in claim 1 in which said engine auxiliary mechanism is a distributor.

12. A V-type overhead-camshaft engine as defined in claim 1 in which said openings are communicated with the interior space defined by the cylinder head assembly which communicates with the interior space of the crankcase defined by the lower part of the cylinder block and an oil pan.

13. A V-type overhead-camshaft engine as defined in claim 1 in which said opening in the first cylinder head assembly forms said engine auxiliary mechanism mounting section.

14. A V-type overhead-camshaft engine as defined in claim 1 in which said opening in the second cylinder head assembly forms said engine auxiliary mechanism mounting section.

* * * * *